US008408402B2

(12) United States Patent
Ranby

(10) Patent No.: US 8,408,402 B2
(45) Date of Patent: Apr. 2, 2013

(54) DESK ORGANIZER

(75) Inventor: David Bruce Ranby, Auckland (NZ)

(73) Assignee: Go-Go-Station NZ Limited, Auckland (NZ)

( * ) Notice: Subject to any disclaimer, the term of this patent is extended or adjusted under 35 U.S.C. 154(b) by 0 days.

(21) Appl. No.: 13/053,982

(22) Filed: Mar. 22, 2011

(65) Prior Publication Data

US 2011/0240570 A1 Oct. 6, 2011

(30) Foreign Application Priority Data

Apr. 1, 2010 (NZ) ..... 584404

(51) Int. Cl.
*B42F 17/00* (2006.01)

(52) U.S. Cl. ..... 211/10

(58) Field of Classification Search ..... 211/10, 211/11, 126.1, 133.6, 26.2, 119.005, 45, 211/50, 126.13; 206/371, 562, 563, 576; 248/311.2, 441.1, 146
See application file for complete search history.

(56) References Cited

U.S. PATENT DOCUMENTS

D79,536 S * 10/1929 Tararo ..... D19/79
D184,013 S * 12/1958 Jarvi ..... D19/92
D199,738 S * 12/1964 Davis ..... D6/476
D201,759 S * 7/1965 Davis ..... D6/462
4,044,980 A * 8/1977 Cummins ..... 248/456
4,384,647 A * 5/1983 Schweizer ..... 206/371
4,429,796 A * 2/1984 Sussman ..... 211/11
D301,590 S * 6/1989 Foran et al. ..... D19/77
D303,813 S * 10/1989 Foran et al. ..... D19/77
4,991,712 A * 2/1991 Wagner ..... 206/214
D317,461 S * 6/1991 Willie ..... D19/75
D319,075 S * 8/1991 Sweeny et al. ..... D19/77
5,052,943 A * 10/1991 Davis ..... 439/357
D322,356 S * 12/1991 Harshaw et al. ..... D3/313
D327,092 S * 6/1992 Evenson ..... D19/75
D331,423 S * 12/1992 Brussing ..... D19/75
D331,942 S * 12/1992 Kirchner ..... D19/78
D332,630 S * 1/1993 Brussing ..... D19/77
D332,968 S * 2/1993 Peersmann ..... D19/77
D333,841 S * 3/1993 Henricksen ..... D19/78
D333,842 S * 3/1993 Kirchner ..... D19/78
D335,307 S * 5/1993 Brussing ..... D19/75
D336,926 S * 6/1993 Brussing ..... D19/75
5,244,173 A * 9/1993 Kulyk ..... 248/176.1
5,265,735 A * 11/1993 Hassel et al. ..... 211/11
D342,095 S * 12/1993 Peersmann ..... D19/78

(Continued)

OTHER PUBLICATIONS

New Zealand Examination Report—584404—Mar. 23, 2011.

(Continued)

*Primary Examiner* — James O Hansen
*Assistant Examiner* — Kimberley S Wright
(74) *Attorney, Agent, or Firm* — Young & Thompson

(57) ABSTRACT

A desk organizer is adapted to be located between a computer screen and keyboard to store or locate various items of stationery. The desk organizer has an elongate body, having an upper inclined surface facing the user and a lower surface to face and abut a support surface. The elongate body is shaped having recesses to removably locate various items therein and at least one device support surface to support an IT device. The device support surfaces are positioned in the elongate body at the ends such that when a device is located on the device support surface a user can both secure and operate the IT device with one hand.

2 Claims, 8 Drawing Sheets

U.S. PATENT DOCUMENTS

| | | | | | |
|---|---|---|---|---|---|
| D346,402 | S | * | 4/1994 | Hassel et al. | D19/75 |
| D373,794 | S | * | 9/1996 | Ming | D19/75 |
| D396,246 | S | * | 7/1998 | Cheris et al. | D19/75 |
| 6,173,656 | B1 | * | 1/2001 | Blanchard | 108/43 |
| D457,191 | S | * | 5/2002 | Slater et al. | D19/78 |
| D457,566 | S | * | 5/2002 | Slater et al. | D19/77 |
| 6,454,369 | B1 | * | 9/2002 | Cooper et al. | 312/223.3 |
| D469,810 | S | * | 2/2003 | Joss et al. | D19/75 |
| 6,591,990 | B2 | * | 7/2003 | Lanman et al. | 211/10 |
| 6,681,926 | B2 | * | 1/2004 | DeVolpi | 206/224 |
| 6,892,875 | B2 | * | 5/2005 | DeVolpi | 206/224 |
| 7,021,473 | B2 | * | 4/2006 | Langford et al. | 211/13.1 |
| D525,308 | S | * | 7/2006 | Lara | D19/92 |
| D555,730 | S | * | 11/2007 | Rosenbaum et al. | D19/85 |
| 7,480,138 | B2 | * | 1/2009 | Kogan et al. | 361/679.02 |
| 7,642,912 | B2 | * | 1/2010 | Sholem | 340/539.32 |
| D667,503 | S | * | 9/2012 | Ranby | D19/75 |
| 2006/0201895 | A1 | * | 9/2006 | Jackson | 211/13.1 |

OTHER PUBLICATIONS http://www.amazon.com/Simply-Put-Deluxe-Charging-Station/dp/B0012Y319K (available from Amazon.com since Nov. 15, 2007).

http://www.amazon.com/Bluelounge-Refresh-Charging-Tray-White/dp/B002MA9BKQ/ref=pd sbs hg 35 (available from Amazon.com since Oct. 2, 2000).

http://www.amazon.com/Charging-Station-Keeps-Things-Organized/dp/B003D2FXJU/ref=pd sbs hg 11 (available at Amazon.com since Mar. 19, 2010).

http://cableorganizer.com/product-showcase/2009/12/31/faux-leather-charging-station/(published Dec. 31, 2009).

* cited by examiner

DESK ORGANIZER

BACKGROUND OF THE INVENTION

1. Field of the Invention

The invention relates to a desk organizer for locating stationary items and portable IT devices such as cell phones and portable digital assistant (PDA's) on a desk and to a method of operation. The invention is directed particularly but not solely towards providing a stylish solution to allowing use of IT devices such as cell phones and calculators etc with one hand while storing stationary in an unused space between the keyboard and computer screen.

2. Description of the Related Art

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

Desk organizers have been known to be provided as rectangular or circular plastic shaped containers which have the disadvantage of requiring a lot of space on a desk top which may not always be available and/or which may severely restrict the layout of documents placed adjacent to the keyboard and monitor. Other organizers, if placed between a keyboard and computer screen or monitor, may impair a computer operator's vision of the computer screen nor do the make an allowance for keyboard cabling or the support feet of the monitor.

Existing desk organizers are often unsightly and liable to topple when filled with stationery And also do not allow for ease of operability of portable IT devices such as cell phones, calculators and PDA's.

SUMMARY OF THE INVENTION

It is an object of the invention to provide desk organizer and method of operation that ameliorates some of the disadvantages and limitations of the known art or at least provide the public with a useful choice.

In a first aspect the invention consists in a desk organizer adapted to be located between a computer screen and keyboard to locate various items, the desk organizer comprising an elongate body, having ends, a front and back, shaped to face a user whereby there is an upper inclined body surface facing the user and a lower body surface to face and abut a support surface, the upper and lower surfaces separated by a depth dimension, the depth dimension of the elongate body being shaped having the upper surface including at least one recess to removably locate various items therein and at least one device support surface to support an IT device whereby the dimension from device support surface to the rear face of the elongate body desk organizer is dimensioned such that a user can both secure and operate the IT device with at least one hand.

Preferably, there are device support surfaces at each end of the desk organizer.

Preferably the desk organizer is shaped in plan, having a curved or angled shape to form a wrap-around shape whereby the front is lower than the rear or the depth of the front is less than the depth of rear.

Preferably the lower body surface of the desk organiser has feet at each end forming a tunnel portion in between.

Preferably the recesses are shaped to fit stationery like items wherein there are tubular chimney like recess for writing implements and shallow rectangular recesses for note pads.

Preferably the device support surface includes an upper portion formed as an upright surface and a lower portion formed as a shelf like base, together as an inclined L shaped seating surface, with a spaced vertical back surface dimensioned and spaced from upright surface, such that one hand with the fingers located behind on back surface and a thumb to both secure and operate the device.

Preferably the elongate body is fabricated from clear plastics material.

In a second aspect the invention consists in a method of operating a desk organizer adapted to be located between a computer screen and keyboard to locate various items, the desk organizer comprising an elongate body, having ends, a front and back, shaped to face a user whereby there is an upper inclined body surface facing the user and a lower body surface to face and abut a support surface, the upper and lower body surfaces separated by a depth dimension, the depth dimension of the elongate body being shaped having at least one recess to removably locate or store various items therein and at least one device support surface to support an IT device having operating keys whereby the dimension from the device support surface to the rear face is dimensioned such that a user's hand having fingers and thumb can both secure and operate the IT device, whereby the method includes the following steps of:

placing the IT device onto the device support surface;

place one hand with palm facing end face closest to the device support surface and fingers located behind the elongate body and the thumb 18 located in front of the desk organizer and IT device with the thumb 18 being free to move as required;

operating the keys of the IT device with the thumb of the same hand.

Preferably the IT device can be a cell phone or PDA.

Preferably the steps can include connecting the IT device to a power source.

BRIEF DESCRIPTION OF THE DRAWING FIGURES

The invention will now be described, by way of example only, by reference to the accompanying drawings.

Figure 3:
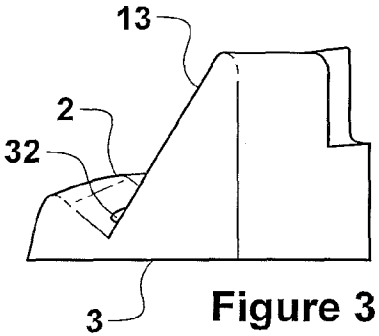

FIG. 3 an end view of the desk organizer

Figure 4:
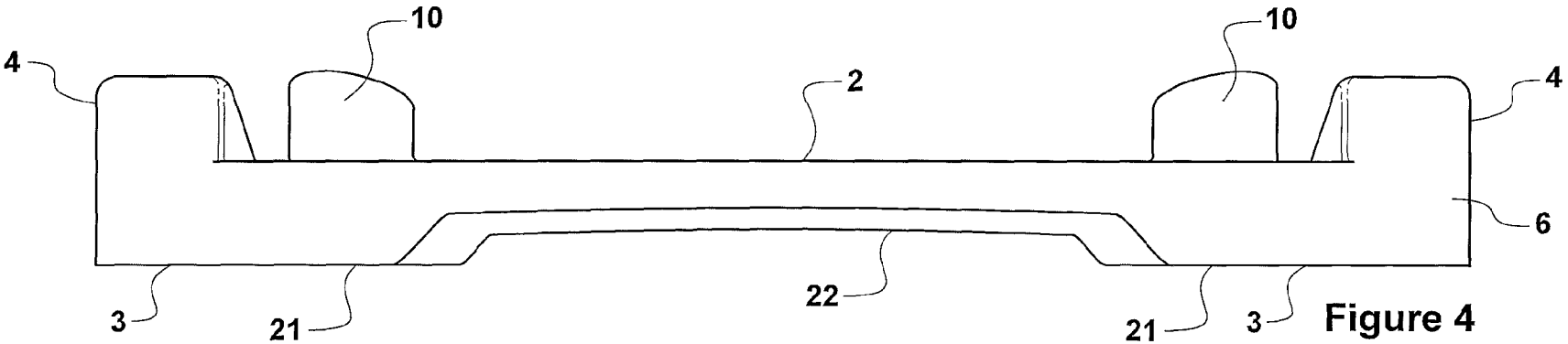

FIG. 4 is a rear view

Figure 5:
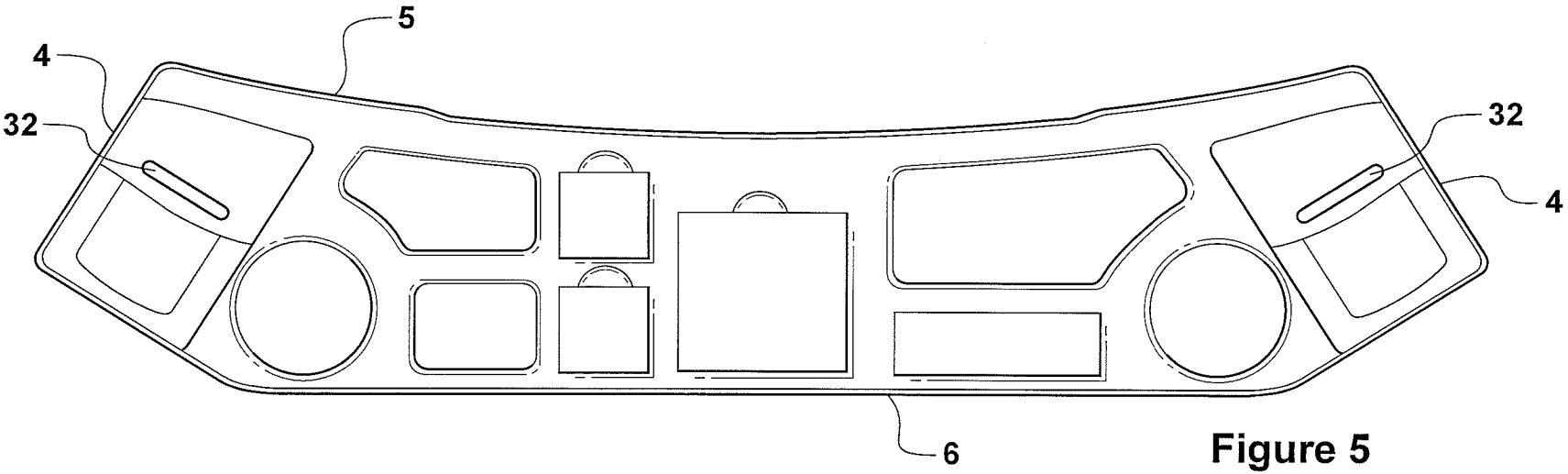

FIG. 5 is a bottom view

Figure 6:
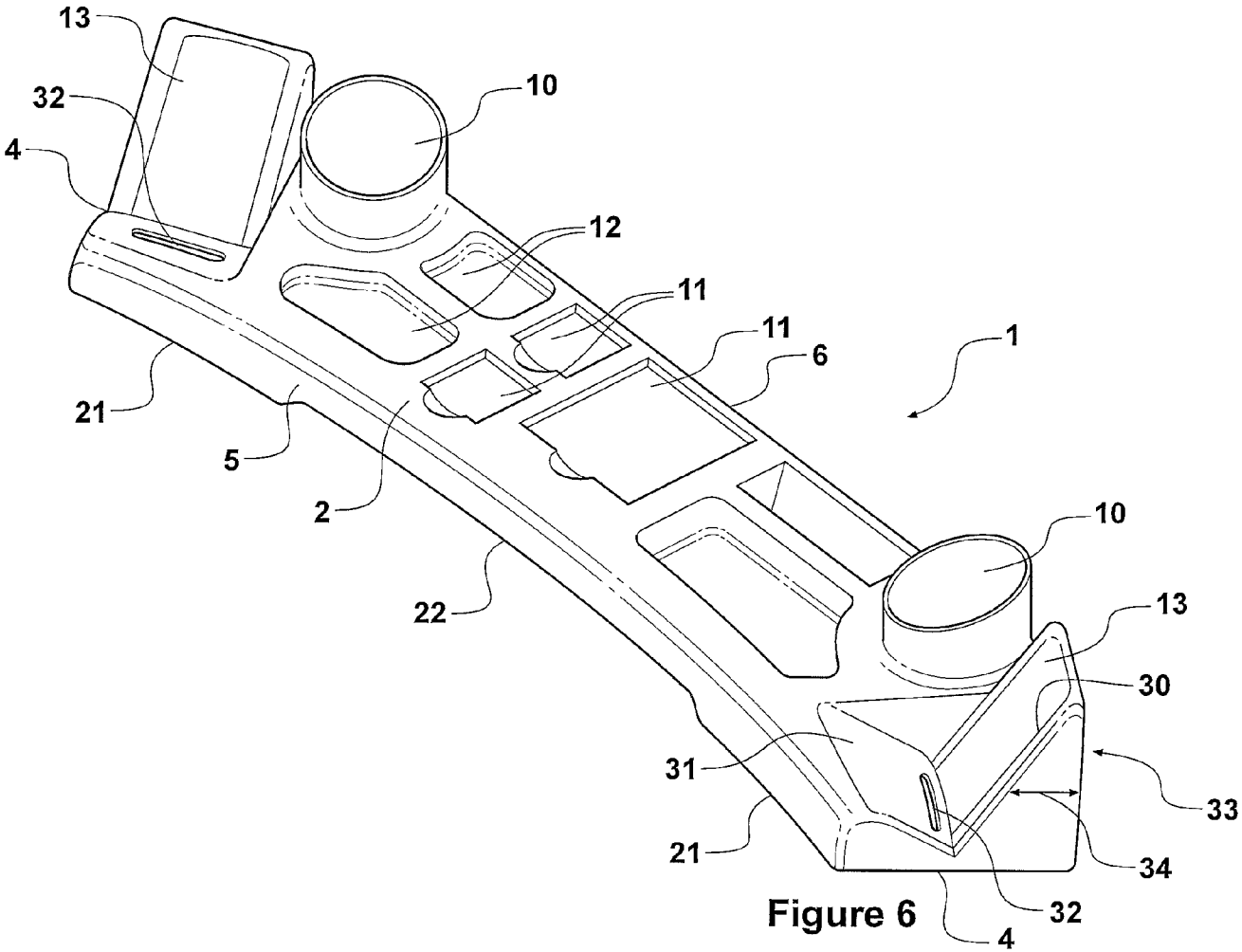

FIG. 6 is a perspective upper view of the desk organizer

Figure 7:
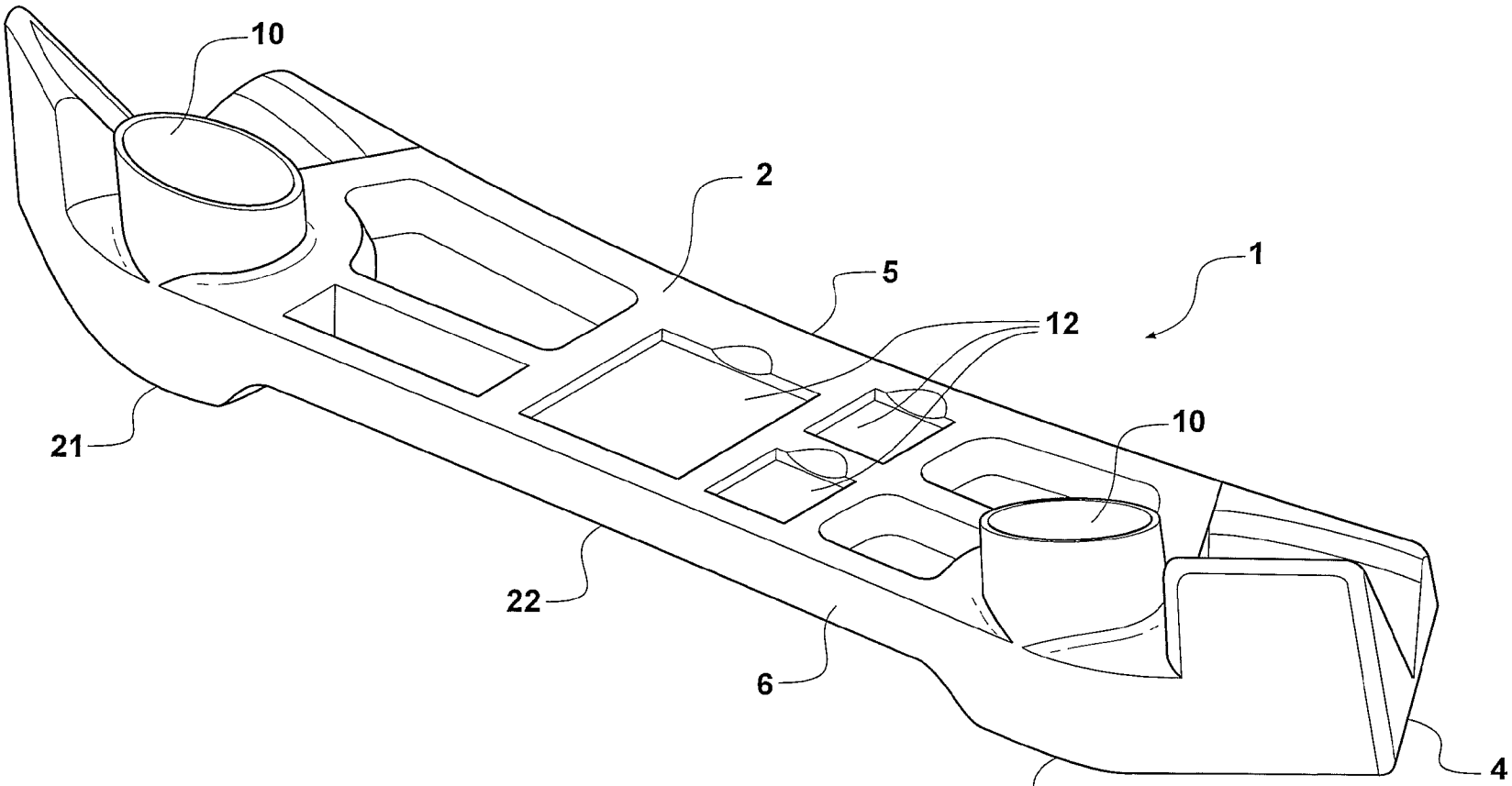

FIG. 7 is a perspective lower view of the desk organizer

Figure 8:
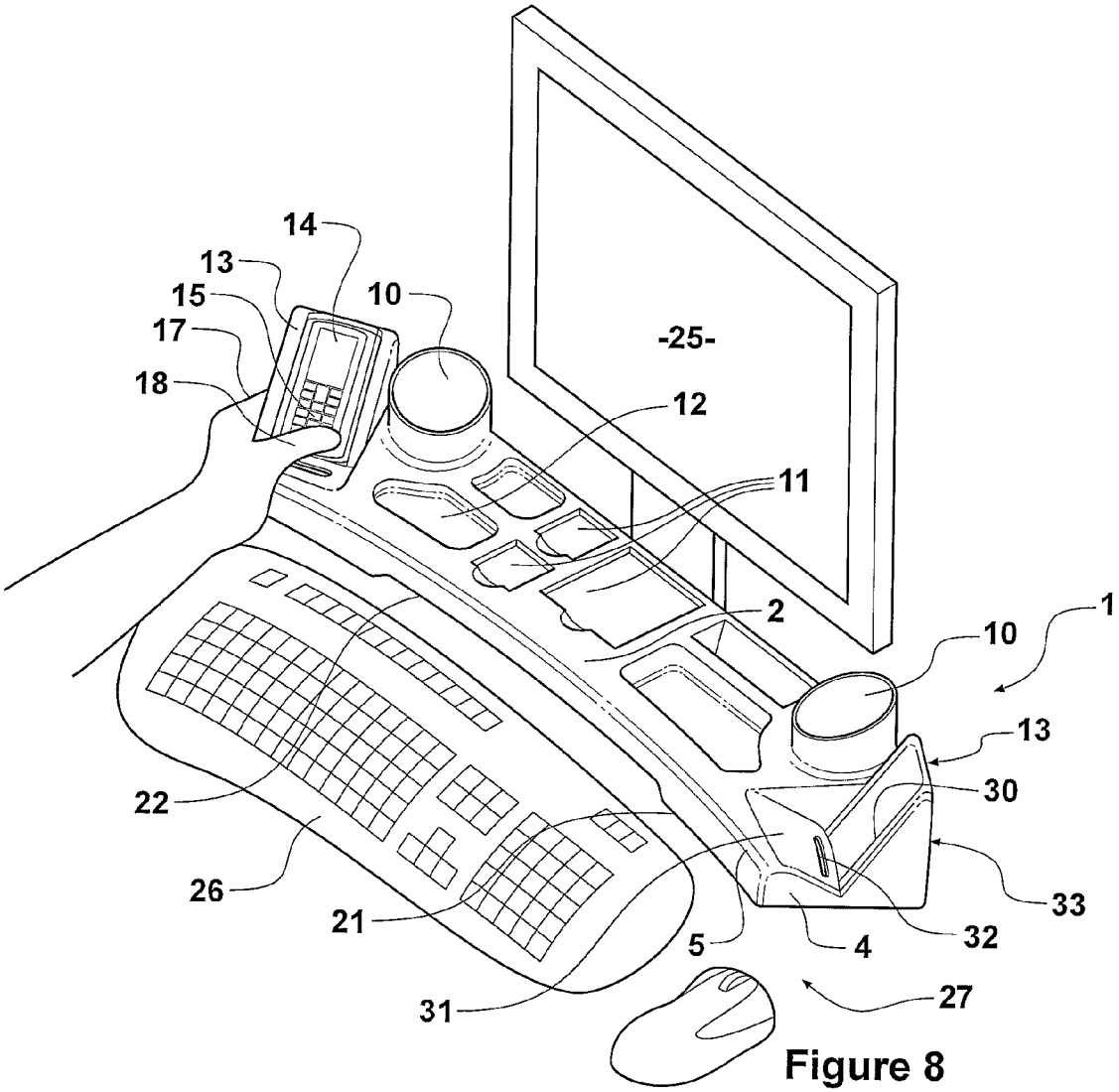

FIG. 8 is a perspective view of the operation of an IT device

Figure 9:
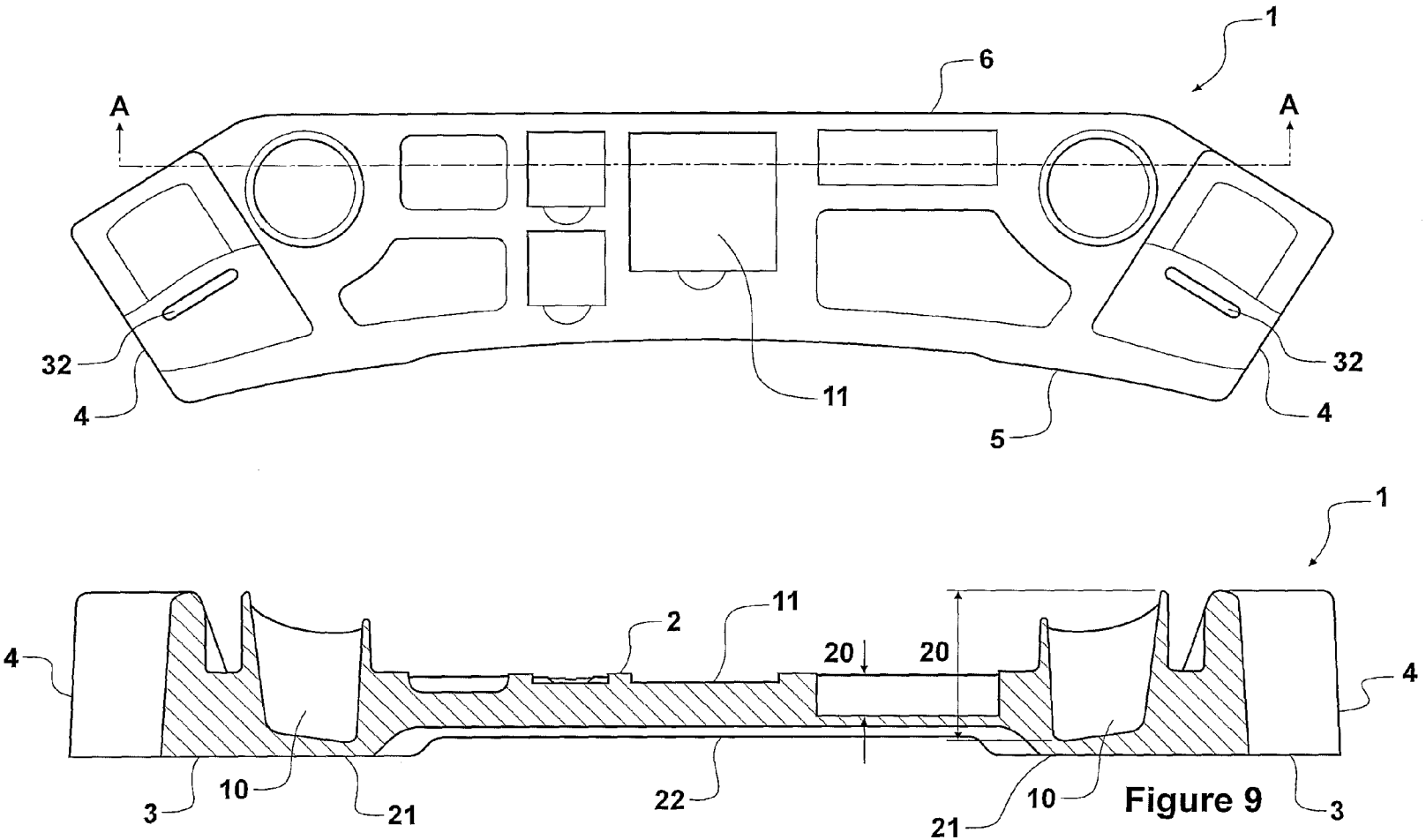
Figure 10:
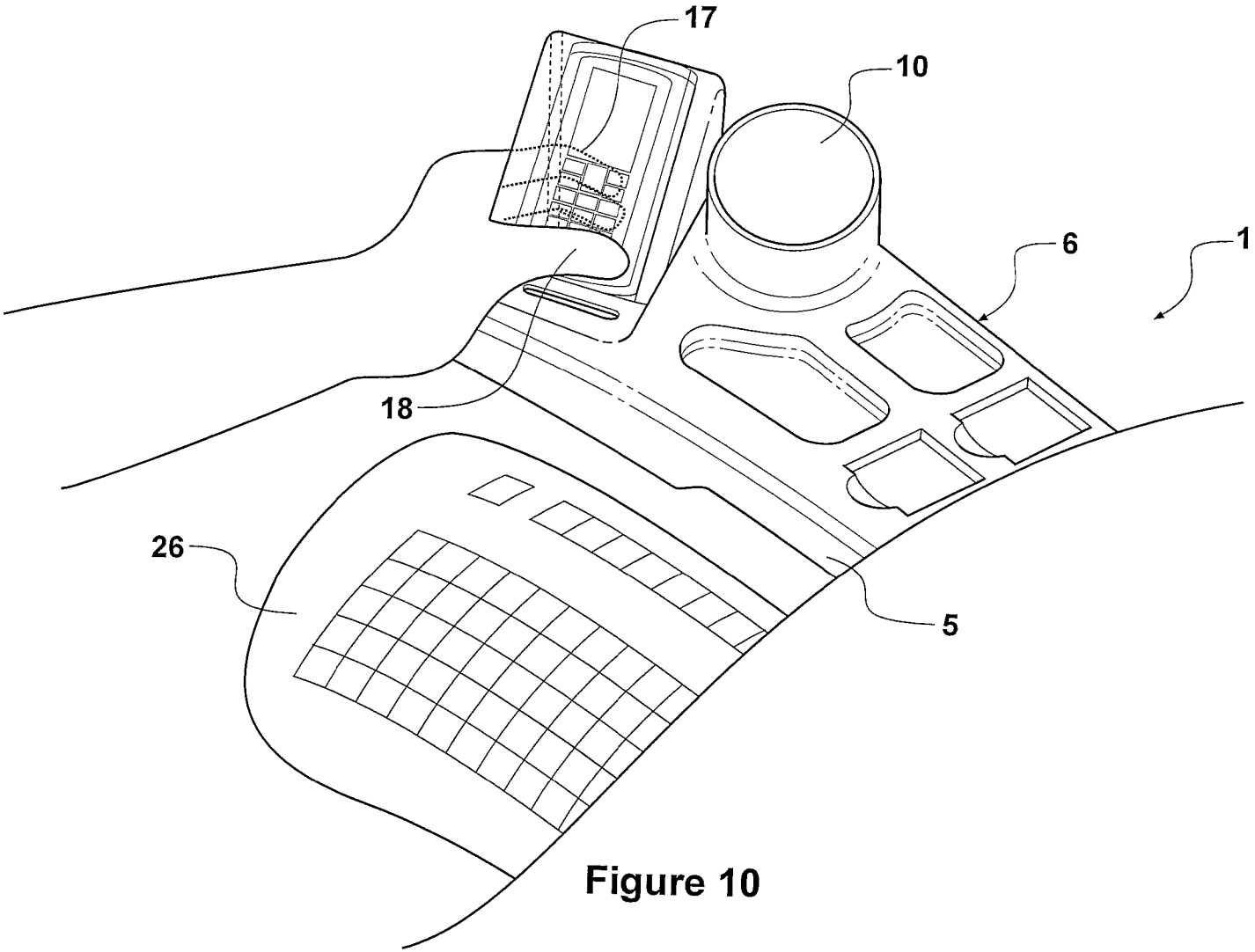

FIG. 9 shows a plan view to locate AA and a length wise cross sectional view along AA FIG. 10 is a close up perspective view of the operation of an IT device

DETAILED DESCRIPTION OF THE INVENTION

The following description will describe the invention in relation to preferred embodiments of the invention, namely a desk organizer. The invention is in no way limited to these preferred embodiments as they are purely to exemplify the invention only and that possible variations and modifications would be readily apparent without departing from the scope of the invention.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

FIGS. 1-10 show one example of a desk organizer 1 having an overall elongate planar shaped body having an upper body surface 2, lower body surface 3, ends with end face 4 and front face 5 and rear face 6. In use the elongate body has the upper body surface 2 facing a user in the form of an inclined body surface. The upper body surface 2 is separated from the lower body surface 3 by a depth dimension which varies. The lower body surface 3 is adapted to abut a support surface like for example a desk top. The elongate body has a length 7 extending between the end face 4 and a width 8 between the front 5 and rear faces 6.

In plan view overall the desk organizer is curved and/or angled to formed a wrap around look with respect to a user. As shown in the figures the front face 5 is strip like in shape with a height being much less than the rear face 6.

In general the end faces 4, front face 5 and rear face 6 are strip-like in extent having less of an area than the upper body surface. The upper body surface 2 is generally planar with recesses therein while the lower body surface is formed having a recessed portion from a peripheral edge surface. The peripheral edge surface of the lower body surface directly abuts the support surface in some or all edges. The lower body surface 3 can be said to be mainly an upwardly recessed lower surface extending from an outer peripheral edge or wall.

The upper body surface 2 of the elongate body is shaped having at least one downwardly directed recess or pocket 10, 11 or 12 to removably accommodate and/or locate at least one item such as stationery items and at least one other shape in the form of an inclined device support surface 13.

Figure 1:
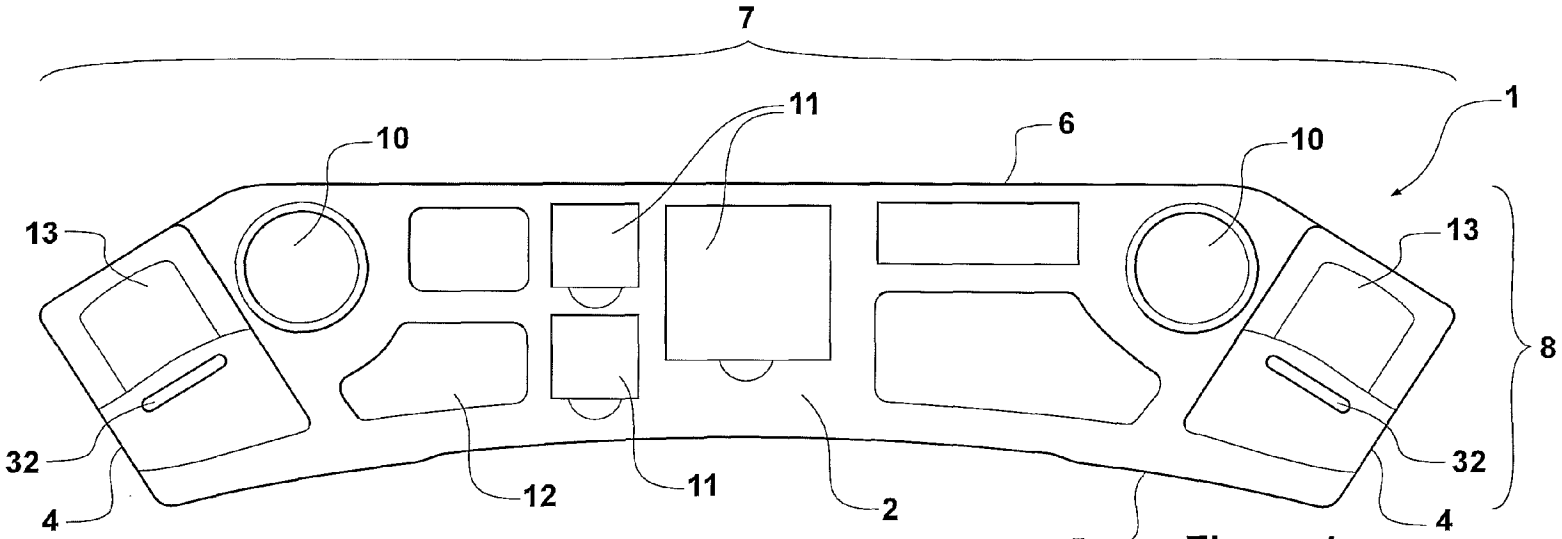
FIG. 1 is a top plan view of the desk organizer in accordance with a first preferred embodiment of the invention.

As shown in FIG. 1 the recess or recesses 10-12 are shown as having various shapes as desired or required, such as an upright tubular recess 10 adapted to removably hold writing implements therein or whatever will fit therein. Other recesses 11 and 12 are shaped and dimensioned to hold other items such as writing pads and clips of various kinds. The recesses are formed such that they appear to be punched down from the upper body surface to protrude downwardly from the upwardly recessed lower body surface 3.

Another type of recess shape is at least one device support surface 13 to support various IT devices 14 being portable or not and having operating keys or touch screen or other such device operating means 15 whereby for example such devices can be cell phones, personal digital assistants (PDA's), calculators, small computers or remote controls. As shown in FIGS. 1, 2, 6, 7, 8 & 10 these device support surfaces 13 are inclined and specifically located at the ends of each elongate body to enable a user to either view and/or operate an IT device.

As shown in FIG. 8 the location and shape of the device support surface 13 with the shape of the elongate body enables a user to press the operating keys 15 of the device 14 eg cell phone with one hand 16 having fingers 17 and a thumb 16 whereby the fingers 17 can be tucked behind the rear face 6 and the thumb 18 is located in front to be able to operate the keys while simultaneously securing or holding the device 14 against thickness of the elongate body in between. This operating sequence also leaves the other hand to perform other duties if required.

As shown in FIG. 9 there is an upper figure (a plan view) and lower figure (cross section) whereby the lower FIG. 9 is a cross sectional view along AA as shown in the upper FIG. 9. The elongate body is shaped whereby the recesses 11 and 12 and device support surfaces 13 downwardly extend from the upper body surface 2 to protrude downwardly to the same or to a different extent 20. Additionally the elongate body is shaped having feet 21 at each end to thereby form a middle tunnel portion 22 there between which is adapted to allow cabling there through or any appendage extending from an adjacent key board or monitor, therein. Front face 5, rear face 6 and end edges 4 form a continuous planar vertical edge of varying height, curvature and angles but having a level bottom surface to enable the elongate body to be self supporting on a support surface.

The front face 5 in this example is lower in height or depth than the rear face 6 so that the upper surface 2 rises away from the user and back towards the rear face 6. In plan view the desk organizer is shaped having a curved front face 5 and angled ends 4 with a straight middle back edge in the rear face 6 and angle rear edges to form a wrap around curved shaped elongate body.

Also shown in FIG. 8 is an example of how the desk organizer 1 can be positioned between a computer screen 25 and keyboard 26 on a support surface like a desk 27.

Figure 2:
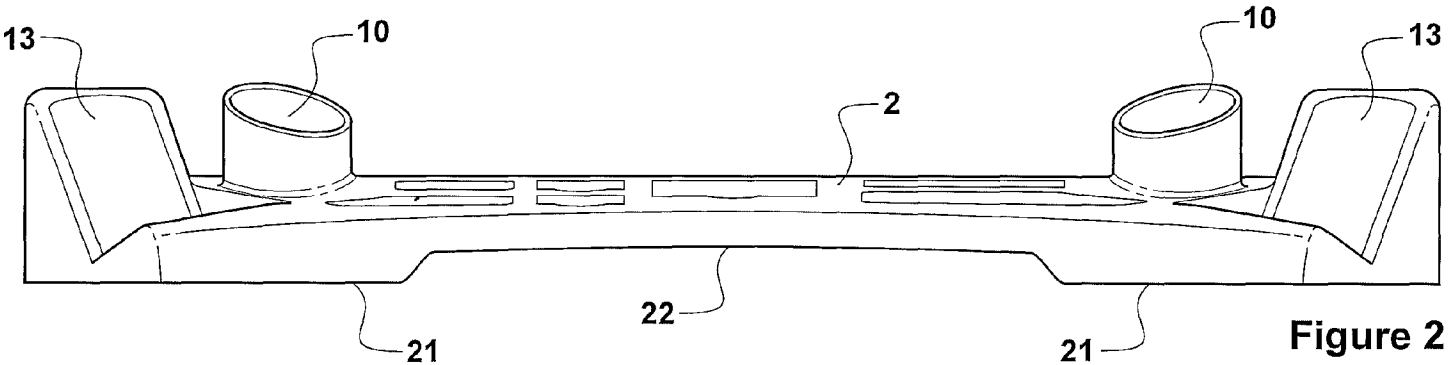
FIG. 2 is a front view of the desk organizer

Device support surface 13 is formed as comprising an upper portion of a semi vertically or upright wall surface 30 and a lower portion with a shelf ledge 31, together formed as a substantially L shaped inclined seating surface. In use or as part of the organizer device support surface 13 is oriented to open outwardly to the front. Inclined wall surface and/or shelf ledge 31 have at least one aperture 32 as shown in FIGS. 1, 5, 6, 8, 9 and 10, whereby one or more power connection means can be located there through. As seen in FIGS. 2 and 6 in cross section the support surface 13 overall is formed as a upwardly protruding portion of the organizer whereby there is a support area back surface 33 of rear surface 6 being substantially vertical with the inclined wall surface 30, forms a triangular like body within or formed as part of the elongate body.

As shown in the figures there is a dimension or distance or depth 34 that extends between the back surface 33 to the front inclined surface 30. This dimension 34 is a sort of thickness dimension which varies so that in use when a user as seen in FIGS. 9 and 10 wishes operate a device 14 located on the surface 13, then one can almost grab the device, by placing the fingers of a hand, behind or onto back surface 33, with the thumb being able to be used to operate the device 14 so that the palm of the hand abuts the end surface 4 of the triangular like body to both secure and be able to operate the device 14.

Also included is a method of operating the desk organizer having an IT device 14 having operating keys or touch screen or any other operating means and stationery therein whereby one hand is able to operate and view the IT device 14 while being able to do other things with the other hand such as access general stationary items or press keys on the keyboard.

The method can include:

- placing the IT device 14 onto the specifically adapted device support surface 13;
- connect up IT device 14 to external power source (not shown) by placing an electrical chord through aperture 32;
- place one hand 16 with palm facing or abutting the end face 4 closest to the device support surface, with fingers 17 located behind the back surface of the rear surface 6 of the elongate body and the thumb 18 located in front of the desk organizer and IT device 14 with the thumb 18 being free to move as required;

operate keys or touch screen of the IT device 147 with thumb 18 while the fingers 17 abut the rear back surface 33 of the rear surface 6 to both secure and enable operating of the IT device 14.

These steps can be varied such as by not connecting the IT device 14 to a power source or by placing the hand against the elongate body before placing or positioning the IT device 14 on to the support surface 13.

The desk organizer makes more efficient use of the desk top space by making more desk top space available for other uses such as lay out of documents. Another advantage of using the desk organiser of the present invention can also include being able to use a smaller desk than before. Also the desk organizer enables some standardization of the storage areas or recesses to occur. Flexible location and orientation of many different types of IT devices is possible, such that they can be easily viewed and operated by the computer operator, thereby improving ergonomic aspects as well.

Any IT device can be operated with minimal effort and energy and with a higher degree of dexterity hence improving accuracy and consistency of output. The shapes and location of the recesses can be altered to suit a users requirements, which can also relate to the type of stationary required. Other aspects can be covered by the present invention include allowing for upgrades to the design to include IT device recharging and PC synchronization stations.

Advantages a) Makes more efficient use of desk top space
b) Modern stylish appearance
c) Tidies the desk top area
d) Provides for standardization of storage spaces
e) Able to use IT device with one hand
f) Modest cost
g) Straightforward manufacture
h) Allows cable access
i) Shape allows abutment with screen and keyboard
j) Lightweight
k) Can be customized
l) Can include means to allow cable connection

VARIATIONS

Throughout the description of this specification, the word "comprise" and variations of that word such as "comprising" and "comprises", are not intended to exclude other additives, components, integers or steps.

It will also be understood that where a product, method or process as herein described or claimed and that is sold incomplete, as individual components, or as a "kit of Parts", that such exploitation will fall within the ambit of the invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However it is to be understood that the invention may assume various alternative variations, except where expressly specified to the contrary. It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

Though the elongate body is shown with specific recesses and support surfaces, other shapes and dimensions that fit the central tunnel shape 22 are equally possible. Also the recesses need not be symmetrically located with respect to the front of the organizer. The organizer can be made in any suitable material of any desired colours. Electrical fittings can also be included in the elongate body to allow cell phones to be charged or electrically operated. Any suitable object such as stationery or any other type of object can be stored or located on or in the organizer.

The lower surface can be formed as a series of protruding shapes or there may be a flat surface. The drawings show the desk organizer moulded or formed as a one piece item but it is equally possible that desk organizer can be formed from inter-fitting components to allow one to 'dial-up' what they want or simply form it from a kit of parts in a flat pack. For example the feet can be formed as separate add-ons or can be formed as fold-out tab portions like as seen under key boards. Also the lower surface 3 can be formed such that it is a mirror image of the upper surface 2 depending on how the recesses 10-12 and support surfaces 13 are formed. In yet other options any parts or portions of the upper surface 2 can be fitted with friction grips or cushioning felt to assist in stabilizing the organizer on a support surface and/or reduce any scraping or noise associated with its use.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

I claim:

1. A desk organizer adapted to be located between a computer screen and keyboard on a desktop, to locate various items, the desk organizer comprising an elongate body, having ends, a front face and a rear face, shaped to face a user stationed in a seated position to operate the keyboard;

an upper inclined body surface facing the user;

device support surfaces at each end of the desk organizer;

a lower body surface to face and abut a support surface, the upper and lower surfaces separated by a depth dimension, the depth dimension of the elongate body being shaped having the upper surface including a plurality of recesses to removably locate various items therein, at least one recess being shaped to fit stationary items, at least one recess being tubular for writing implements and at least one recess being a shallow rectangular recess for note pads, and at least one device support surface adapted to support an IT device thereon whereby the dimension from the device support surface to the rear face of the elongate body desk organizer is dimensioned and shaped such that a user can both secure the IT device to the support surface and operate the IT device with at least one hand having a portion of the hand secured to the rear face and another portion of the hand able to operate the keys of the IT device while the hand's forearm rests on the desktop; and feet at each end of the lower body surface forming a tunnel portion in between, wherein the desk organizer has a curved or angled shape to form a wrap-around shape whereby the front face is lower than the rear face or a depth of the front face is less than the depth of rear face, and the device support surface includes an upper portion formed as an upright surface and a lower portion formed as a shelf base surface, together as an inclined L shaped seating surface, with a spaced vertical back surface dimensioned and spaced from the upright surface, to allow one hand with the fingers located behind on the rear surface and a thumb to both secure and operate the IT device.

2. The desk organizer as claimed in claim 1 wherein, the elongate body is fabricated from clear plastics material.

* * * * *